US005277325A

United States Patent [19]

Yan

[11] Patent Number: 5,277,325

[45] Date of Patent: Jan. 11, 1994

[54] CONTAINER WITH LOCKABLE CAP

[75] Inventor: Chan M. Yan, Vancouver, Canada

[73] Assignee: Sunflower Enterprises Ltd., Toreola, British Virgin Isls.

[21] Appl. No.: 86,108

[22] Filed: Jul. 6, 1993

[51] Int. Cl.[5] ..... B65D 55/02

[52] U.S. Cl. ..... 215/206; 215/221; 222/545; 222/548

[58] Field of Search ..... 215/365, 206, 213, 221, 215/228; 222/545, 546, 548

[56] References Cited

U.S. PATENT DOCUMENTS

| | | | |
|---|---|---|---|
| 3,782,577 | 1/1974 | Levey | 222/545 |
| 4,464,316 | 8/1984 | Michaels | 215/221 |
| 4,512,484 | 4/1985 | Mar | 215/221 |
| 5,115,928 | 5/1992 | Drummond, Jr. | 215/221 |

*Primary Examiner*—Joseph Man-Fu Moy

*Attorney, Agent, or Firm*—Brian M. Long

[57] ABSTRACT

A lockable container has a neck on a container body and a cap on the neck. Screw-threads releasibly retain the cap on the neck. The cap includes a locking member which is movable between a locking position, in which the locking member prevents the relative rotation of the cap and the neck, and a released position, in which the locking member permits the relative rotation of the cap and the neck. A pair of annular members extending around the closure and rotatable independently of one another interengage with the locking member for releasibly retaining the locking member in the locking position and can be rotatably adjusted of the annular members to release the locking member for movement to its released position. On movement of the locking member into its locking position, a closure connected to the locking member closes an outlet in the cap for preventing outflow of liquid from the container.

8 Claims, 3 Drawing Sheets

CONTAINER WITH LOCKABLE CAP

BACKGROUND OF THE INVENTION

1. Field of the Invention

The present invention relates to containers and, more particularly, to containers of the type which are provided with a cap incorporating annular members which must be rotated into predetermined positions relative to one another to permit the outflow of liquid from the container.

2. Description of Related Art

It has previously been proposed to provide a container closure having a pouring spout and a combination locking device controlling the opening of the spout, so that the contents of the container can be accessed only by a person who is informed as to the combination required to open the spout.

One such container is disclosed, for example, in U.S. Pat. No. 3,782,577, issued Jan. 1, 1974 to John Levey and which has annular coaxially disposed rotatable annular locking elements for retaining a pivotal portion of the closure in a closed position by rotating the annular elements into predetermined indexed registering positions, the pivotal portion of the closure can be pivoted so as to provide a passageway which permits pouring of the contents of the container.

It is, however, a disadvantage of this prior container closure that the annular elements, which control the pivoting and closing of the pouring passageway, do not also control the retention of the cap on its container.

More particularly, the present inventor has perceived that there is a need for a lockable container for use, for example, by a child, which can be released, by appropriate actuation of a combination-type locking device, to allow the contents of the container to be poured from the container, and in addition which also enables the cap to be entirely removed from the container, for the purpose of refilling the container, under the control of the locking device.

BRIEF SUMMARY OF THE INVENTION

It is accordingly an object of the present invention to provide a normal and improved container provided with a cap having annular members which are readily rotatable in order to release a closure and thereby to allow the outflow of liquid from the container and, in addition, to enable the cap to be removed.

According to the present invention, there is provided a container having a container body with a neck on the container body and a cap on the neck. The cap and the neck have interengageable portions, preferably screw-threaded, for releasibly retaining the cap on the neck and the interengageable portions being releasible from one another by relative rotation of the cap and the neck. The cap includes a locking member which is movable between a locking position, in which the locking member prevents the relative rotation of the cap and the neck, and a released position, in which the locking member permits the relative rotation of the cap and the neck. A pair of annular members extending around the closure and rotatable independently of one another have inner sides which interengage with the locking member for releasibly retaining the locking member in the locking position. The inner sides of the annular members are formed with gaps which can be aligned relative to the locking member, by rotation of the annular members, so as to release the locking member for movement to its released position. A closure is connected to the locking member for closing an outlet in the cap for the outflow of liquid from the container on movement of the locking member into its locking position.

With this device, the locking member thus controls not only the opening of the outlet in the cap but also the removal of the cap from the container neck.

In a preferred embodiment of the invention, the locking member is a vertically extending elongated locking member which is longitudinally movable so that one end of the locking member is engaged with an abutment, in the form of one end of a recess in the container body, when the locking member is in its locking position. This abutment therefore prevents the relative rotation of the cap and the container neck, so that the cap cannot be unscrewed from the container neck.

BRIEF DESCRIPTION OF THE DRAWINGS

Further features, objects and advantages of the present invention will be more readily apparent from the following description thereof when taken in conjunction with the accompanying drawings, in which:

FIG. 5 shows a view corresponding to that of FIG. 4, but with the locking member in its released position.

THE PREFERRED EMBODIMENT

Figure 1:
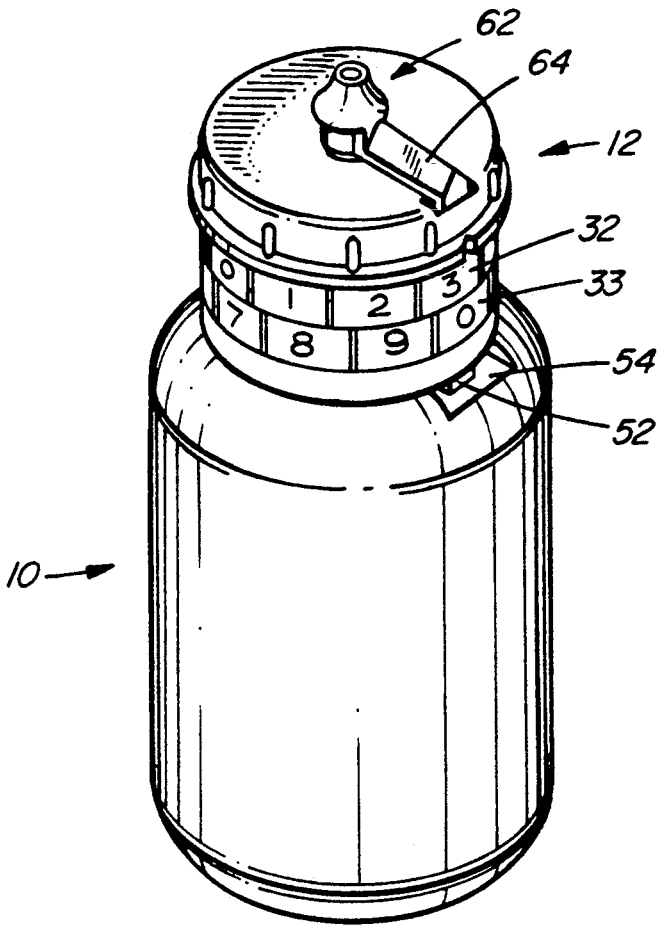
FIG. 1 shows a view in perspective of a container according to the present invention, with a locking member in its locking position.
Figure 2:
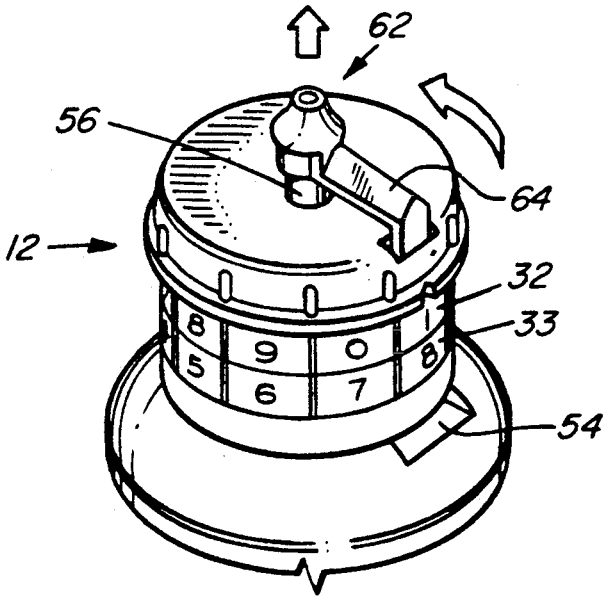
FIG. 2 shows a portion of the container of FIG. 1, in perspective, with a locking member in its opened position.

The container shown in FIG. 1 has a container body indicated generally by reference numeral 10, and a combination lockable cap 12, and is made of plastics material.

Figure 4:
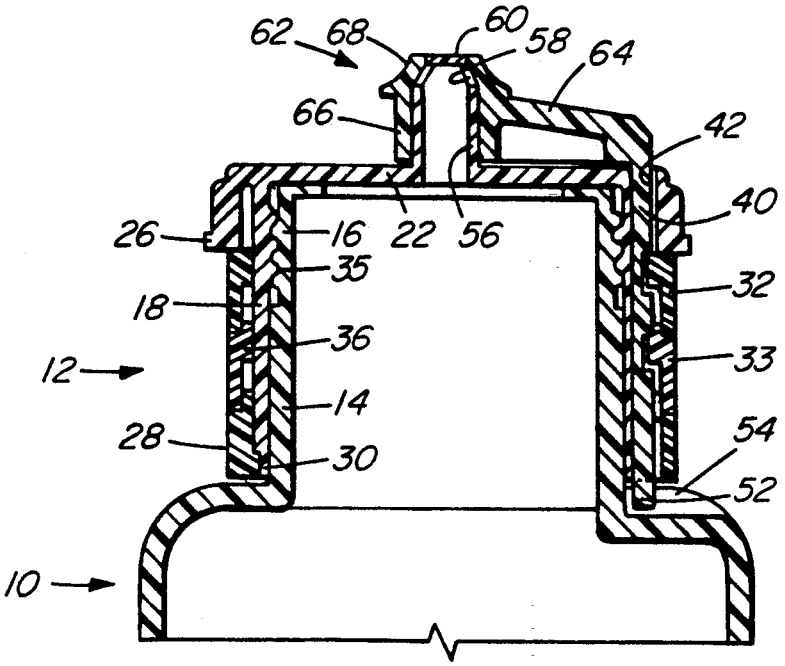
FIG. 4 shows a view in vertical cross section through parts of the container of FIG. 1 and its cap, with the locking member in its locking position.
Figure 5:
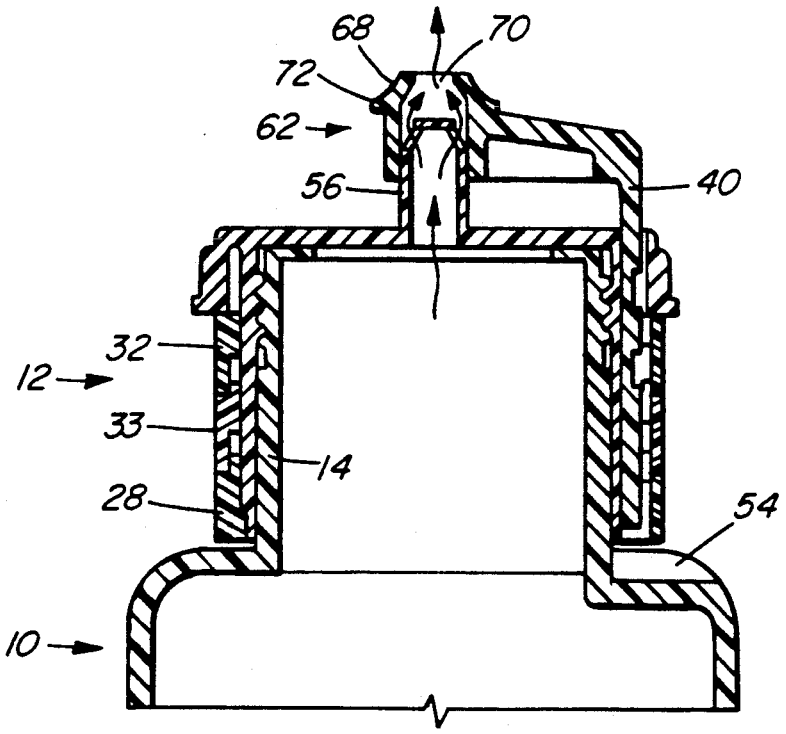
FIG. 5 shows an exploded view of the components of the cap of the container of FIGS. 1 and 2.

As can be seen from FIGS. 4 and 5, the container body 10 is provided with a cylindrical neck 14, which has an externally threaded upper portion 16.

The cap 12 has a cylindrical skirt portion 18, which extends around the container neck 14 and which includes a threaded portion 20 in threaded engagement with the threaded portion 16 of the container neck 14. The shirt portion 18 has a closed top 22, which is interrupted by an upstanding cylindrical spout, indicated generally by reference numeral 24, and a laterally outwardly projecting rim forming an annular shoulder 26.

An annular retainer 28 is secured to an open bottom 30 of the skirt portion 18 by an adhesive (not shown). It will be readily apparent to those skilled in the art that, instead of employing adhesive, the skirt portion open bottom 30 and the annular retainer 28 may be formed with portions which are mutually engageable, as by a snap action, for retaining the annular retainer 28 in position relative to the skirt portion 18.

Between the annular retainer 28 and the annular shoulder 26, there are provided a pair of coaxial annular members 32 and 33. The annular members 32 and 33 are rotatable relative to one another about the skirt portion 18 and are formed at their inner sides with inwardly projecting ribs 35 and 36, which are in sliding engagement with the outer surface of the skirt portion 18.

Figure 3:
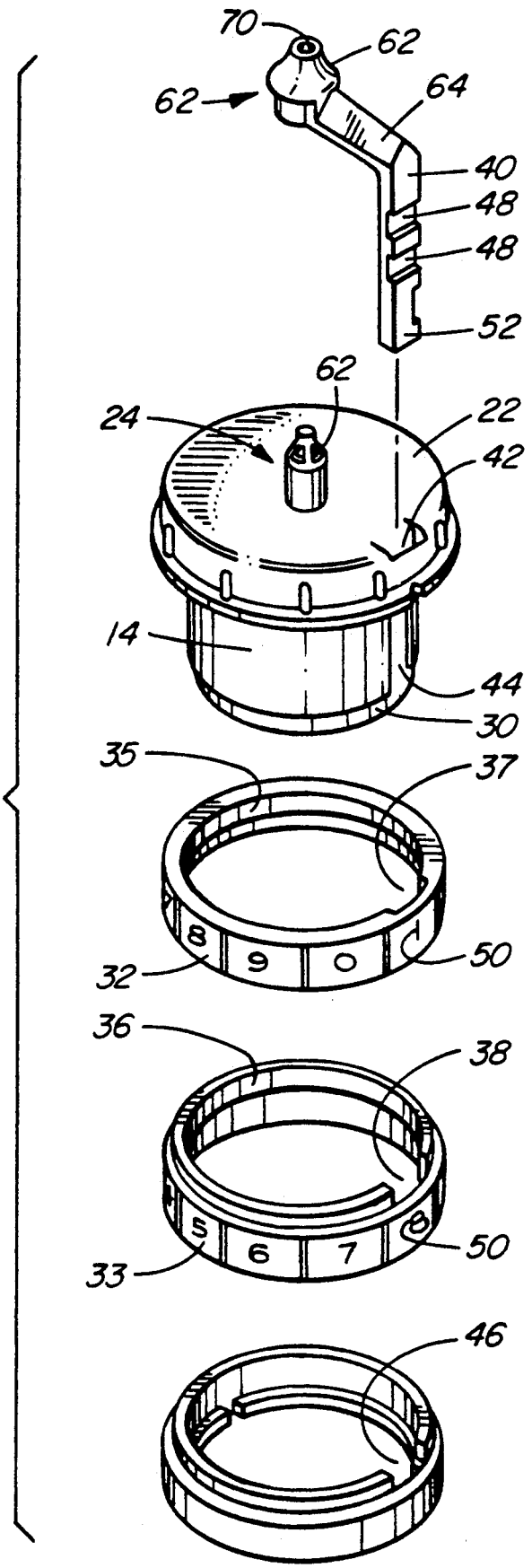

As shown in FIG. 3, the ribs 35 and 36 are interrupted by gaps 37 and 38, respectively.

A vertically extending elongate locking member 40 extends downwardly at one side of the cap 12 between the skirt 18 and the annular members 32 and 33.

More particularly, the locking member 40 extends through an opening 42 in the annular shoulder portion 26 of the cap and is slidably received in a vertical slot 44 in the outer surface of the skirt 18. The locking member 40 further extends through gap 46, which is formed at the inner side of the annular retainer 28.

At an outer side thereof, the locking member 40 is formed with two horizontally extending slots 48 which, when the locking member 40 is in the position in which it is shown in FIG. 4, slidably receive the ribs 35 and 36 of the annular members 32 and 33, so that the latter can be rotated around the skirt portion 18.

The annular members 32 and 33 are provided, on their outer sides, with indicia in the form of numerals 50 so that, by mutually aligning an appropriate pair of the numerals 50 with the locking member 40, so as to locate the gaps 37 and 38 in alignment with the locking member 40, the latter can be moved upwardly, from the locking position in which it is shown in FIG. 4, to a released position, in which it is shown in FIG. 5.

When the locking member 40 is in its locking position, a lower end portion 52 of the locking member 40 engages in an indentation or recess 54, which is formed in the exterior of the container body 10. Consequently, one end of the recess 54 forms an abutment for the locking member 40, which prevents rotation of the container cap 12 relative to the neck 14.

The spout 24 forms an outlet passage for the outflow of liquid from the interior of the container, as described in greater detail below, and comprises a tubular portion 56, which is upstanding from the container top portion 22, an upwardly convergently tapered frusto-conical portion 58 at the top of the cylindrical portion 56, and a circular top 60 closing the top of the frusto-conical portion 58. The frusto-conical portion 58 is formed with openings 62 (FIG. 3), through which the liquid can flow when the locking member 40 is in its released position.

To prevent such an outflow of liquid through the spout 24 when the locking member 40 is in its locking position, the locking member 40 is formed in one piece with a spout closure indicated generally by reference numeral 62, which is connected to the locking member 40 by a bridge portion 64 extending radially outwardly from the closure 62. The locking member 40, the bridge portion 64 and the spout closure 62 are formed in one piece.

The closure 62 has a lower, cylindrical portion 66, which fits snugly and slidably around the spout tubular portion 56, and an upper portion 68 the shape of which is complimentary to that of the frusto-conical portion 58 of the spout 24.

When the locking member 40 is in its locking position and when the closure 63 is consequently in its closed position, in which it is shown in FIG. 4, the upper portion 68 of the closure 63 fits closely against the frusto-conical portion 58 of the spout 24 and, therefore, closes the openings 62, so as to prevent the outflow of liquid through the spout 24.

However, when the locking member 40 is moved into its released position, as shown in FIG. 5, then the closure 63 is simultaneously moved into an opened position, in which it is shown in FIG. 5. When the closure 63 is in this opened position, the upper portion 68 of the closure 63 is removed from the frusto-conical portion 58 of the spout, thus opening an outflow passage through the spout 24, so that liquid can flow from the spout 24 through the openings 62 and through a circular outlet opening 70 in the top of the closure upper portion 68.

The locking member and the closure 63 can be readily moved to and fro between the positions in which they are shown in FIGS. 4 and 5 by manually gripping the bridge portion 64.

The closure 63 is formed with an outwardly projecting annular peripheral rim 72, which can be readily engaged by a finger or a fingernail to facilitate displacement of the closure 63 upwardly from its closed position of FIG. 4 towards its open position of FIG. 5.

In use, and with the cap 12 removed from the container neck 14, a beverage or other drinking liquid can be poured into the container body 10.

The cap 12 is then screwed onto the container neck 40, by threaded engagement of the threaded neck portion 16 with the threaded skirt portion 20, while the locking member 40 is retained in its released position. The cap 12 is then rotatably adjusted, to locate the locking member 40 above the recess 54, if necessary, and the locking member 40 is pressed downwardly to bring its lower end portion 52 into the recess 54. Simultaneously, the closure 63 is pressed downwardly onto the spout 24 so as to close the latter. The annular members 50 are then rotated so as to displace the gaps 37 and 38 from the locking member 40.

When the user of the container wishes to pour liquid from the container, he or she firstly sets the appropriate combination, using the numerals 50, so as to align the gaps 37 and 38 with the locking member 40, and then displaces the locking member 40 from its locking position to its released position, thereby unlocking the cap and opening the outlet passage through the spout 24 for the outflow of liquid as indicated by arrows in FIG. 4.

After a portion or all of the contents of the container have been poured through the spout 24, the locking member 40 can be returned to its locking position, and the annular members 50 can be rotated to secure the locking member 40 in its locking position.

When it is desired to refill the container, then the container cap 12 is again unlocked, as described above, and the container cap 12 is then rotated relative to the container neck 40 so as to unscrew the cap 12 from the container neck 14.

As will be readily apparent to those skilled in the art, various modifications may be made in the above described container within the scope and spirit of the appended claims.

For example, the abutment for retaining the lower end 52 of the locking member 40 may be formed by an outwardly projecting portion of the container body, or by a projection or recess in the container neck, instead of by the container body recess 54.

I claim:

1. A container, comprising:

a container body;

a neck on said container body; and a cap on said neck;

said cap and said neck having interengageable portions for releasibly retaining said cap on said neck and said interengageable portions being releasible from one another by relative rotation of said cap and said neck;

said cap including:

a locking member which is movable between a locking position, in which said locking member prevents the relative rotation of said cap and said neck, and a released position, in which said locking member permits the relative rotation of said cap and said neck;

a pair of annular members extending around said closure and being rotatable independently of one another, said annular members having inner sides which interengage with said locking member for releasibly retaining said locking member in said locking position, and said inner sides of said annular members being formed with gaps which can be aligned relative to said locking member, by rotation of said annular members, so as to release said locking member for movement to its released position;

an outlet in said cap for the outflow of liquid from said container; and a closure connected to said locking member for closing said outlet on movement of said locking member into its locking position.

2. A container as claimed in claim 1, wherein said container is formed with an external recess for receiving an end portion of said locking member, on movement of said locking member into its locking position, whereby said cap is restrained from rotation relative to said neck.

3. A container as claimed in claim 1, wherein:

said outlet is defined by a first tubular portion upstanding from said cap;

said first tubular portion terminating at its top in an upwardly tapering portion;

said tapering portion having a closed top and openings being formed in said tapered portion for the outflow of the liquid; and wherein:

said closure comprises a second tubular portion fitting snugly and slidably around said first tubular portion and having an upper portion the shape of which is complimentary to that of said tapered portion;

said upper portion being movable between a closed position and an opened position on movement of said locking member from its locking position to its released position;

said upper portion having an open top for the outflow of the liquid when said closure is in its open position; and said upper portion being shaped to close said openings when said closure is its closed position.

4. A container, comprising:

a container body;

a neck on said body; and a cap on said neck;

said cap and said neck having interengageable threaded portions for releasibly retaining said cap on said neck and said threaded portions being releasible from one another by relative rotation of said cap and said neck;

said cap including:

a vertically extending elongate locking member which is longitudinally movable between a locking position and a released position;

said locking member and said container body having portions which are mutually engageable, on movement of said locking member into its locking position, for retaining said cap against rotation relative to said neck and said mutually engageable portions being disengageable from one another, by movement of said locking member into its released position, to allow the relative rotation of said cap and said neck;

a pair of annular members extending around said closure and being rotatable independently of one another, said annular members having outer sides bearing indicia and inner ribs which interengage with said locking member for retaining said locking member in said locking position, and said inner ribs of said annular members being formed with gaps which can be aligned with said locking member, by rotation of said annular members, so as to release said locking member for movement to its released position;

an outlet in said cap for the outflow of liquid from said container; and a closure connected to said locking member for closing said outlet on movement of said locking member into its locking position.

5. A container as claimed in claim 4, wherein said interengageable portions of said locking member and said container body comprise an end portion of said locking member and an external recess in said container body.

6. A container as claimed in claim 4, wherein said closure is formed in one piece with said locking member.

7. A container as claimed in claim 4, wherein:

said outlet is defined by a first tubular portion upstanding from said cap;

said first tubular portion terminating at its top in an upwardly tapering portion;

said tapering portion having a closed top and openings being formed in said tapered portion for the outflow of the liquid; and wherein:

said closure comprises a second tubular portion fitting snugly and slidably around said first tubular portion and having an upper portion the shape of which is complimentary to that of said tapered portion;

said upper portion being movable between a closed position and an opened position on movement of said locking member from its locking position to its released position;

said upper portion having an open top for the outflow of the liquid when said closure is in its open position; and said upper portion being shaped to close said openings when said closure is its closed position.

8. A container as claimed in claim 4, wherein said cap comprises a cylindrical skirt portion extending around said neck and having a closed top and an open bottom; a laterally projecting annular shoulder around said top, said annular shoulder being formed in one piece with said skirt portion; and an annular retainer extending around and secures to said bottom of said skirt portion; said annular members being retained by and between said annular shoulder and said annular retainer; said annular shoulder and said annular retainer being formed with openings for slidably receiving said locking member and said locking member being vertically movable through said openings and within said annular members between its locking position and its released position.

* * * * *